US005123534A

United States Patent [19]

Chwang

[11] Patent Number: 5,123,534

[45] Date of Patent: Jun. 23, 1992

[54] PACKAGING ASSEMBLY FOR LITE STRINGS

[75] Inventor: Wen T. Chwang, Hsinchu, Taiwan

[73] Assignee: Marriot International Co., Ltd., Taiwan

[21] Appl. No.: 683,309

[22] Filed: Apr. 10, 1991

[51] Int. Cl.[5] ..... B65D 85/42

[52] U.S. Cl. ..... 206/419; 206/480; 206/481

[58] Field of Search ..... 206/419, 420, 421, 422, 206/477, 478, 479, 480, 481, 482, 483, 328, 329

[56] References Cited

U.S. PATENT DOCUMENTS 3,822,783 7/1974 Mortensen ..... 206/480
3,923,152 12/1975 Minneman ..... 206/478 X
4,228,896 10/1980 Wu ..... 206/420
4,971,200 11/1990 Huang et al. ..... 206/420

FOREIGN PATENT DOCUMENTS 1451827 10/1976 United Kingdom ..... 206/329

*Primary Examiner*—William I. Price
*Attorney, Agent, or Firm*—Andrus, Sceales, Starke & Sawall

[57] ABSTRACT

A packing cell for installing lite sets and their accompanying wires includes a base member made of thin material having a opening thereon. A first fastening member extends vertically to a suitable height from one end of the base member. A second fastening member is parallel with the first fastening member and extends vertically to the same height of the first fastening member from the base member. The first fastening member and second fastening member jointly secure whole strings of lite sets and their wires.

3 Claims, 4 Drawing Sheets

PACKAGING ASSEMBLY FOR LITE STRINGS

FIELD OF THE INVENTION

The present invention relates to a packing cell, and in particular to a packing cell and its assembly for installing lite sets and their accompanied wires.

DESCRIPTION OF THE PRIOR ARTS

In the past, the lite sets which are wisely used at Christmas were packed, during their transportation, by a very simple method as well as with very simple materials, such as thin plates of paper. Those packing plates had many rectangular holes for installing said sockets and bulbs onto the plates. The packing process comprised first winding the wire around a paper plate and in the meantime, inserting the sockets of the bulbs into said holes. After finishing this installing, said plate together with the strings was put into a box made also of paper. Since the plate is flexible and the box can not constrain a certain force exposed on it, a great deal of bulbs were broken during the transportation.

Gradually, a box made of polyethylene was introduced to pack the lite sets strings. The box had many recesses for inserting the sockets of bulbs. The packing involved inserting the sockets into those recesses first, then arranging and putting the wires around the sockets. No doubt the box made of polyethylene could resist more exposed pressure than a paper box and the loss of the lamps during transportation was greatly reduced. But the polyethylene can not be disintegrated in our natural environment. It caused a terrible pollution and was discontinued.

In the ROC utility patent application No. 7124276, FIG. 1, the inventor disclosed a packing frame which includes a vertical wall 1*a* which receives the connecting wires of the lite sets in its recesses 1*b*, and a pair of pins 1*c* which jointly fastens the lamps 1*d* of the lite sets. Said frame also includes some vertical walls around its edges for protecting said lamps.

In another ROC utility patent application No. 79205793, FIG. 2, the inventors disclosed a further improvement for packing the lite sets. This packing frame for lite sets includes a base member in which a hook 2*a* together with a hook 2*b* and a pin 2*c* were used to secure each single socket. In this arrangement, the wires of the lite sets need to wind around the packing frame.

Of course those two frames could be used as a packing frame of lite sets, but possess the following defects:

1) First, the main holding force from the packing frame to the lite sets resides on the bulbs and wires, mostly on the bulbs, since the bulbs are secured firmly between the fastening means. As we know, the wall of a bulb is very thin and no doubt it will be broken if we apply much force on it, as in a packing process when the worker holds on to the socket and inserts the bulb into the narrow opening between said pins 1*c*, FIG. 1, and said hook 2*a*. The most potential risk is the worker's finger might be hurt by broken fragments. Besides, it is also not easy to put the wires into the opening between hook 2*b* and pin 2*c*. While in dismounting the sets from the packing frame, some pulling force will occur between the wires and conducting plate inside the socket and too much force will also make the connection fail, and checking out which connection has failed is really troublesome; and
2) The winding of the wires is time wasting. In the packing frame disclosed in FIG. 2, the worker needs to wind the wires to the back of the frame. This takes time both in winding and unwinding.

Hence the objective of the present invention is in providing a novel technique which solves all the problems which the prior arts encountered and lets the packing of lite sets be done more safely and efficiently.

SUMMARY OF THE PRESENT INVENTION

In order to achieve the above mentioned objective the packing cell according to the present invention includes a base member having a hole in its middle. A first fastening member extends vertically to a suitable height from one end of the base member. Said first fastening member includes a first catching plate, a second catching plate and a third catching plate. Said first catching plate and second plate connect with each other at their bottoms and jointly define a grasping seat which receives firmly the sockets of said lite sets. A second fastening member is parallel with the first fastening member and extends vertically to the same height as the first fastening member from the base member. Said second fastening member includes also a first catching plate, a second catching plate and a third catching plate. Said first catching plate and second plate connect with each other at their bottoms and jointly define a grasping seat which receives firmly the sockets of said lite sets. Hence the first fastening member and second fastening member cooperatively secure firmly the lite sets and its wires.

The structural and operational characteristics of the present invention and its advantages as compared to the known state of the prior art will be better understood from the following description, relating to the attached drawings which show an example of a packing cell and also a packing frame integrated by lots of packing cells according to the present invention. In these drawings.

Figure 1:
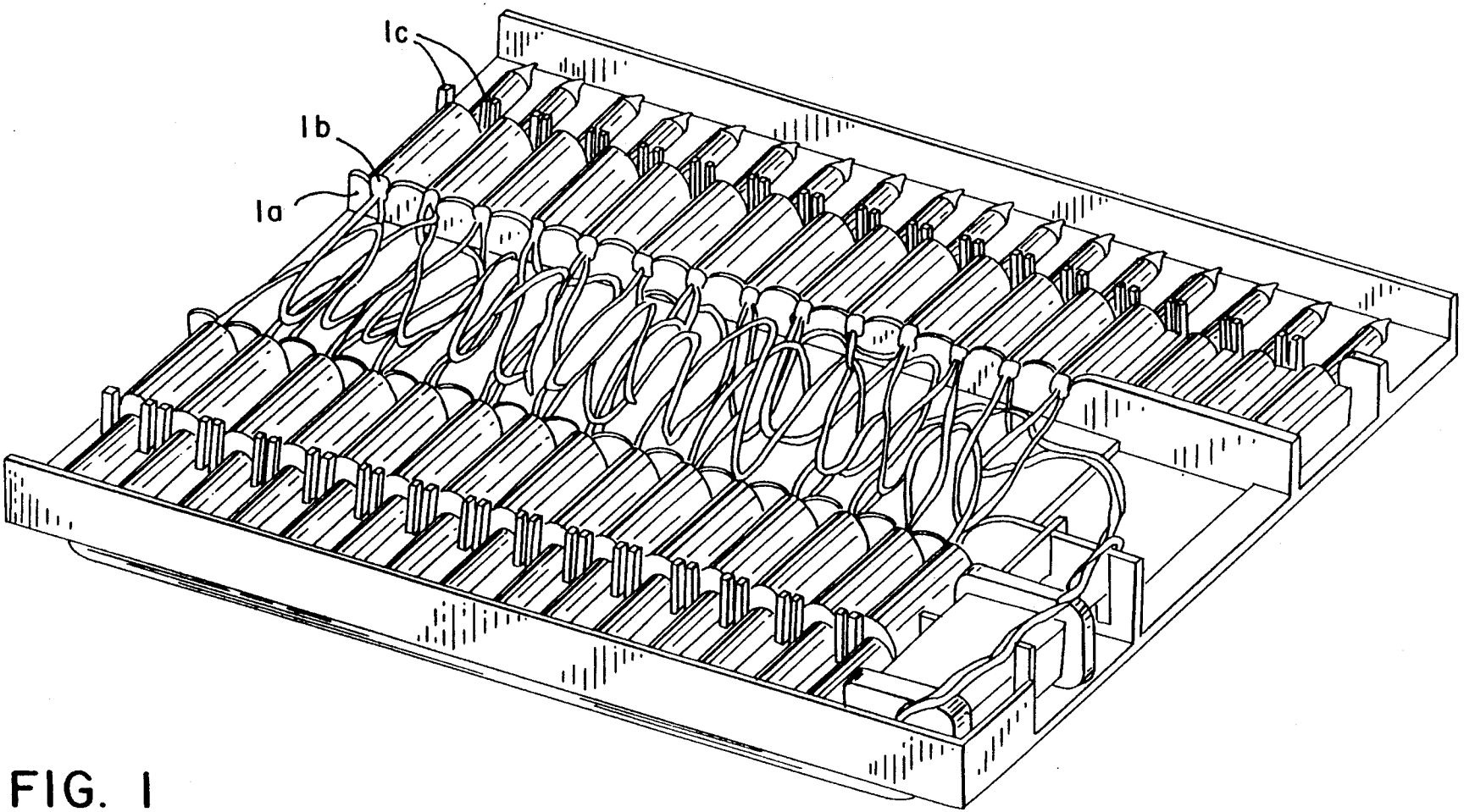
FIG. 1 PRIOR ART
FIG. 1 is the perspective view of ROC utility patent application No. 7124276 discussed above.
Figure 2:
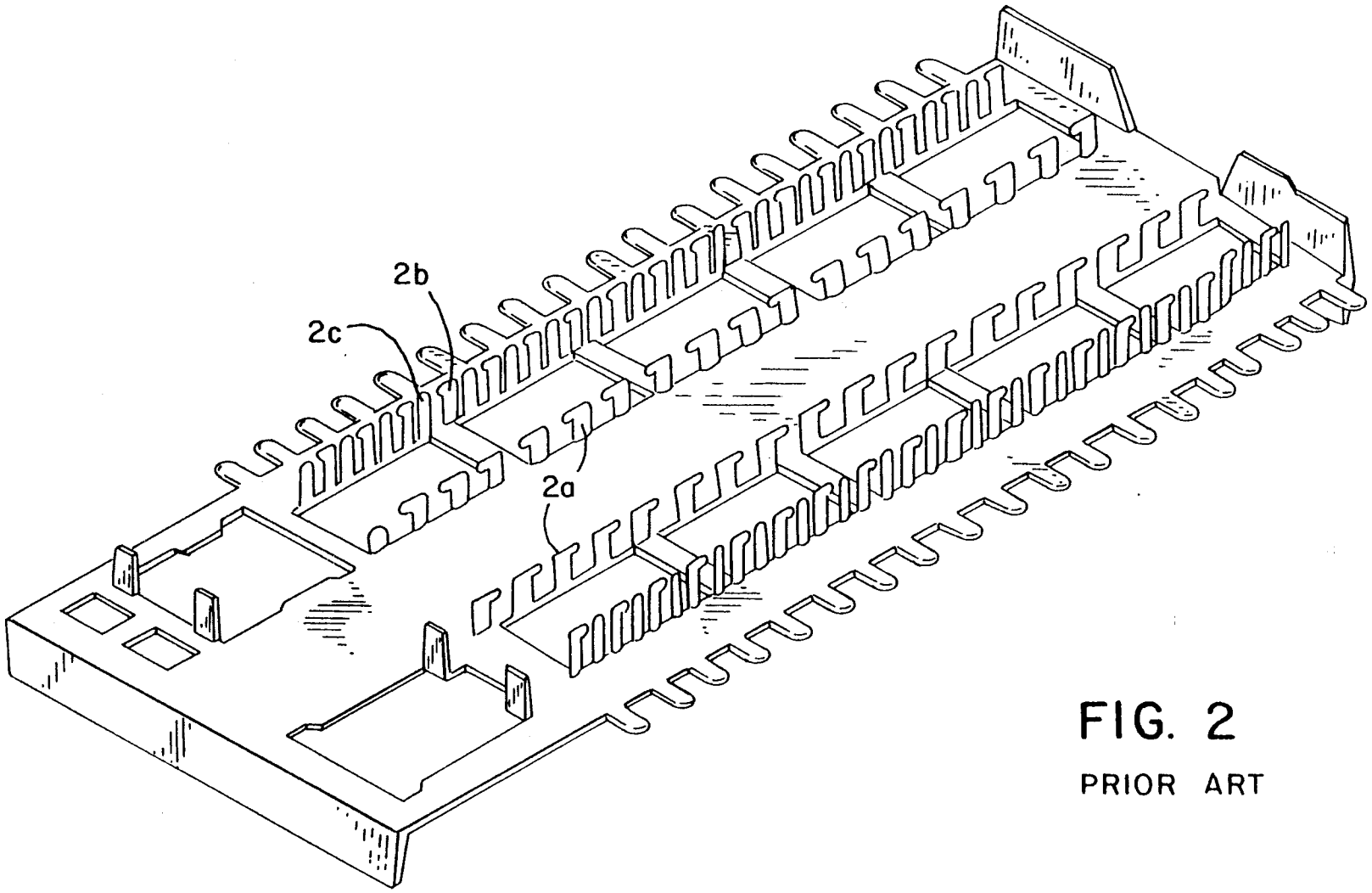
FIG. 2 PRIOR ART
FIG. 2 is a perspective view of another ROC utility patent application No. 79205793 discussed above.
Figure 3:
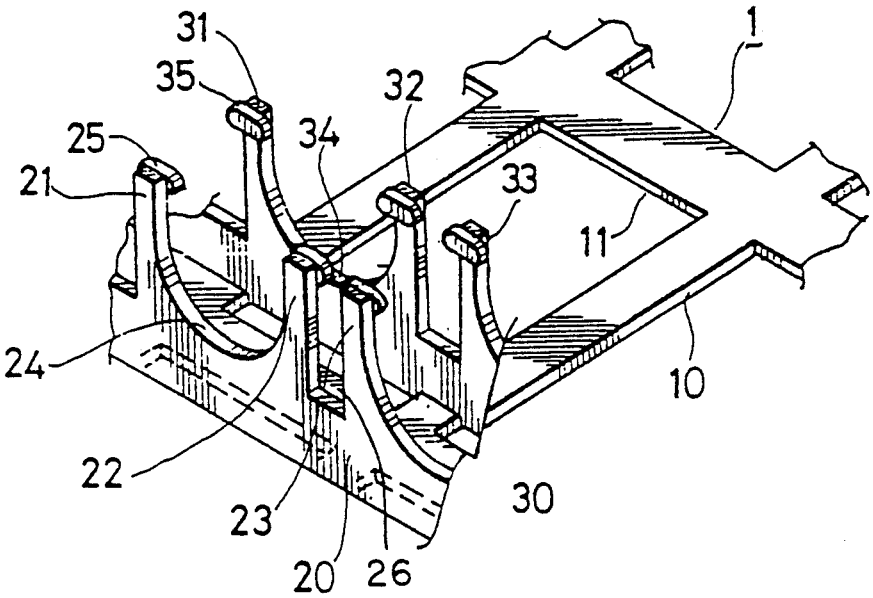
FIG. 3 is the perspective view of a packing cell according to the present invention.
Figure 4:
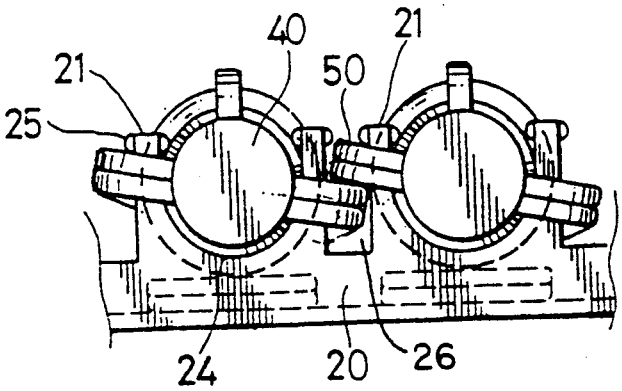
FIG. 4 is the side view of two packing cells illustrating the arrangement between the socket of the lite sets and seat of first fastening member.

Please refer to FIG. 3 and 4 showing, the perspective view and side elevation view of packing cell according to the present invention. Said packing cell 1 includes a base member 10 having a hole therein. A first fastening member 20 extends vertically to a suitable height from ne end of the base member 10. Said first fastening member 20 includes a first catching plate 21, a second catching plate 22 and a third catching plate 23. Said first catching plate 21 and second plate 22 connect with each other at their bottoms and jointly define a grasping seat 24 which receives firmly the socket 40 of said lite sets. A second fastening member 30 is parallel with the first fastening member 20 and extends vertically to the same height as the first fastening member 20 from the base member 10. Said second fastening member includes also a first catching plate 31, a second catching plate 32 and a third catching plate 33. Said first catching plate 31 and second catching plate 32 connect with each other at their bottoms and jointly define a grasping seat 34 which receives firmly the socket 40 of said lite sets. Hence the first fastening member 20 and second fastening member 30 cooperatively and firmly secure the socket 40 of the lite sets and its wires 50.

In order to provide a stronger grasping force on the socket, said catching plates further includes a projection 25, 35. Because of those projections 25, 35; the opening defined by said first catching plate 21, 31 and second catching plate 22, 32 will be a little less than the diameter of said socket 40. While said socket 40 slides over said projections 25, 35, said socket 40 will firmly be secured by said catching plate 21, 22 and 31, 32. Besides, said seats 24, 34 have a suitable height to cause the bulb to hang above the base member 10. For the wires 50, it will be put into said split 26, 36 defined by said second catching plate 22, 32 and third catching plate 23, 33 and then the wires will not jump out.

In the packing process, the worker may hold on the socket and insert it into said fastening members. Since the main force resides on the outer surface of said socket and because said socket and catching plate are made from plastic material or other equivalent which have a preferably rigid ability, damaging of the bulbs can be prevented since no force will be exposed on them. In light of this natural way of holding on to the socket and inserting it into said seats defined by said fastening members, not only does the packing rate increase, but also the need of worry to the injury of fingers decreases.

While installing the socket onto the fastening members, the accompanied wires will also be arranged orderly. Both ends which are near the two adjacent sockets will be firstly put into the split 26, 36 defined by said second catching plate 22, 32 and third catching plate 23, 33 and the remaining wires will be put aside the bulbs or under them. We will describe this in more detail when referring to FIG. 5.

Figure 5:
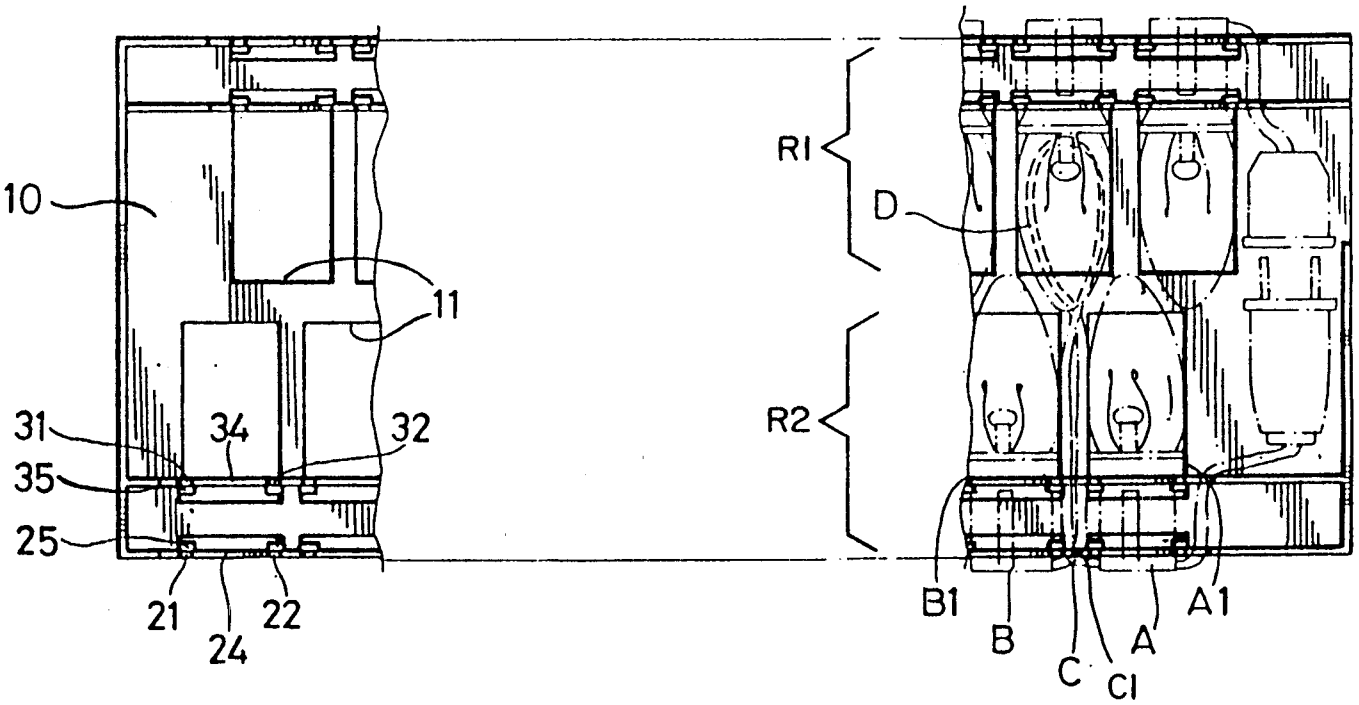
FIG. 5 is a top view of a packing frame integrated by a plurality of packing cells according to the present invention.

With reference to FIG. 5, A and B are two adjacent sockets and C is their connecting wires. While in the packing process, one first inserts A onto the packing cell A1, then puts first the both ends of C onto the split C1. After that, one picks up the middle of C and pulls it a little straight and away from said fastening members then inserts B onto packing cell B1. In FIG. 5 we see said wires 50 were put under the bulbs D which is opposite to A & B. Then one by one, all the sockets and their accompanying wires of strings of lite sets will be installed regularly around the packing assembly.

In FIG. 3, we have mentioned about that a single packing cell 1 includes two fastening members 20, 30 and each comprises a first catching plate 21, 22, a second catching plate 22, 32 and a third catching plate 23, 33. But as a plurality of packing cell 1 integrally construct a packing frame 60, as described in FIG. 5, then said third catching plate 23, 33 could be substituted by said first catching plate 21, 31 of said adjacent packing cell, as shown in FIG. 4. In FIG. 5, we see also each packing cell 1 is spaced apart from each other and said splits 26, 36 are automatically formed.

For a compact packing, each packing frame includes two rows, R1 and R2, of packing cells and R1 has a half cell phase shift ahead of R2. This arrangement will make the top of each bulb be placed between the bulbs of its opposite row.

While the present invention has been explained in relation to its preferred embodiments, it is to be understood that various modifications thereof will become apparent to those skilled in the art upon reading this specification. Therefore, any modifications based on the present invention shall be covered by the appended claims.

I claim:

1. A packaging cell for a light socket of a light set, the light socket having accompanying wires, said packing cell comprising:

a base member formed of a thin, flat, rigid material and having an end;

a first, sheet-like fastening member mounted on said base member proximate said end and extending vertically, with respect to said base member, to a suitable height, said first fastening member including first and second spaced sheet portions having open upper ends and being joined at the base member, said sheet portions defining a first seat structure for receiving the light socket and for grasping the socket in said fastening member by compressive forces exerted on the light socket by said sheet portions;

a second, sheet-like fastening member mounted on said base member at a location spaced from said first member, said second fastening member being parallel to said first member so that said first fastening member and said second fastening member have opposing surfaces, said second fastening member extending vertically, with respect to said base member, to the same height as said first member, said second fastening member including first and second spaced sheet portions having open upper ends and being joined at the base member, said sheet portions defining a second seat structure for receiving the light socket and for grasping the socket in said fastening member by compressive forces exerted on the light socket by said sheet portions, said second seat structure being aligned with said first seat structure; and projections mounted at the upper ends of said sheet portions of said first and second fastening members on the opposing surfaces of said members, said projections extending into said respective first and second seat structures for retaining the light sockets in said seat structures, said first and second sheet portions of said first and second fastening members forming spaces along the sides of the packaging cell for receiving the wires associated with the socket.

2. A packaging frame for light sockets of a light set, the light sockets being connected at intervals along accompanying wires, said packaging frame comprising a plurality of packaging cells arranged in side-by-side relationship with adjacent packaging cells of similar construction, each of said packaging cells comprising:

a base member formed of a thin, flat, rigid material and having an end, said base member forming a common member for all of said cells;

a first, sheet-like fastening member mounted on said base member proximate said end and extending vertically, with respect to said base member, to a suitable height, said first fastening member including first and second spaced sheet portions having open upper ends and being joined at the base member, said sheet portions defining a first seat structure for receiving the light socket and for grasping the socket in said fastening member by compressive forces exerted on the light socket by said sheet portions;

a second, sheet-like fastening member mounted on said base member at a location spaced from said first member, said second fastening member being parallel to said first member so that said first fastening member and said second fastening member have opposing surfaces, said second fastening member extending vertically, with respect to said base member, to the same height as said first member, said second fastening member including first and second spaced sheet portions having open upper ends and being joined at the base member, said sheet portions defining a second seat structure for receiving the light socket and for grasping the socket in said fastening member by compressive forces exerted on the light socket by said sheet portions, said second seat structure being aligned with said first seat structure; and projections mounted at the upper ends of said sheet portions on said first and second fastening members on the opposing surfaces of said members, said projections extending into said respective first and second seat structures for retaining the light sockets in said seat structures, said first and second sheet portions of said first and second fastening members forming spaced along the sides of a given packaging cell with respect to an adjacent cell for receiving the wires associated with the socket.

3. The packaging frame according to claim 2 further comprising two rows of opposed cells, the aligned first and second seat structures of one row being offset from the seat structures of the other row.

* * * * *